US010781611B2

(12) United States Patent
Schildwachter et al.

(10) Patent No.: US 10,781,611 B2
(45) Date of Patent: Sep. 22, 2020

(54) ELECTRIC STRIKE WITH TWO INDEPENDENT LATCHES

(71) Applicant: TRINE ACCESS TECHNOLOGY, INC., Bethel, CT (US)

(72) Inventors: William Schildwachter, Danbury, CT (US); Ferdinand E. Orbeta, Mount Kisco, NY (US)

(73) Assignee: TRINE ACCESS TECHNOLOGY, INC., Bethel, CT (US)

( * ) Notice: Subject to any disclaimer, the term of this patent is extended or adjusted under 35 U.S.C. 154(b) by 0 days.

(21) Appl. No.: 16/307,764

(22) PCT Filed: Jun. 13, 2017

(86) PCT No.: PCT/US2017/037162

§ 371 (c)(1),
(2) Date: Dec. 6, 2018

(87) PCT Pub. No.: WO2018/005075

PCT Pub. Date: Jan. 4, 2018

(65) Prior Publication Data

US 2019/0292812 A1 Sep. 26, 2019

Related U.S. Application Data

(60) Provisional application No. 62/357,483, filed on Jul. 1, 2016.

(51) Int. Cl.
*E05B 47/00* (2006.01)
*E05B 17/20* (2006.01)
(Continued)

(52) U.S. Cl.
CPC ..... *E05B 47/0047* (2013.01); *E05B 17/2084* (2013.01); *E05B 63/04* (2013.01);
(Continued)

(58) Field of Classification Search
CPC ..... E05B 47/0047; E05B 47/0046; E05B 15/022; E05B 15/024; E05B 2047/0073;
(Continued)

(56) References Cited

U.S. PATENT DOCUMENTS 3,465,556 A 9/1969 McIlvenny
5,257,841 A * 11/1993 Geringer ..... E05B 45/083 292/340
(Continued)

FOREIGN PATENT DOCUMENTS

CA 2401162 A1 * 3/2001 ..... E05B 47/0047
DE 102004012112 B3 * 8/2005 ..... E05B 15/0205
(Continued)

OTHER PUBLICATIONS

Machine translation of DE 102006011085, 2019, pp. 1-15 (Year: 2019).*
(Continued)

*Primary Examiner* — Christine M Mills
(74) *Attorney, Agent, or Firm* — Norris McLaughlin PA

(57) ABSTRACT

An electric strike having two independent keepers. The strike works with a lockset having both a deadbolt and a mortise lock bolt. A latch adapted to engage a deadbolt is provided with a solenoid to lock or unlock the latch. Another latch adapted to engage a mortise lock bolt is provided with a solenoid to lock or unlock the latch. Each latch is independently operable.

8 Claims, 4 Drawing Sheets

(51) Int. Cl.
*E05B 63/04* (2006.01)
*E05B 65/10* (2006.01)
*E05B 65/00* (2006.01)

(52) U.S. Cl.
CPC ..... *E05B 65/0032* (2013.01); *E05B 65/10* (2013.01); *E05B 2065/0039* (2013.01)

(58) Field of Classification Search
CPC ..... E05B 2047/0076; E05B 63/0065; E05B 17/2084; E05B 63/04; E05B 65/0032; E05B 65/10; E05B 2065/0039; Y10T 292/696; Y10T 292/699; Y10T 292/702
USPC ..... 292/341.17, 341.15, 341.16
See application file for complete search history.

(56) References Cited

U.S. PATENT DOCUMENTS 5,757,269 A * 5/1998 Roth ..... E05B 45/083 200/61.68
6,568,726 B1 * 5/2003 Caspi ..... E05B 47/0046 292/144
6,913,299 B1 * 7/2005 Stendal ..... E05B 47/0047 292/340
7,021,684 B2 * 4/2006 Orbeta ..... E05B 47/0046 292/201
8,047,585 B1 11/2011 Peabody et al.
8,366,160 B2 * 2/2013 Orbeta ..... E05B 15/0093 292/341.16
2006/0226664 A1 * 10/2006 Edwards ..... E05B 77/48 292/341.16
2008/0006069 A1 * 1/2008 Liao ..... E05B 47/0047 70/413
2011/0241361 A1 10/2011 Orbeta et al.
2017/0292290 A1 * 10/2017 Schildwachter ..... E05B 17/22

FOREIGN PATENT DOCUMENTS

DE 102005015248 A1 * 10/2006 ..... E05C 9/042
DE 102006011085 A1 * 3/2007 ..... E05B 47/0046
DE 102010012736 A1 * 9/2011 ..... E05B 47/0038
DE 202012100072 U1 * 1/2013 ..... E05C 9/1841
EP 2542742 B1 1/2013
WO 2007095665 A1 8/2007
WO 2011107286 A1 9/2011
WO 2013053056 A1 4/2013
WO 2015124929 A1 8/2015
WO 2016064816 A1 4/2016
WO 201800507075 A1 1/2018

OTHER PUBLICATIONS

International Search Report for corresponding application PCT/US2017/037162 dated Aug. 4, 2017.
Written Opinion of the International Searching Authority for corresponding application PCT/US2017/037162 dated Aug. 4, 2017.
EP Search Report for corresponding application EP 17820887.2 dated Feb. 4, 2020.

* cited by examiner

ELECTRIC STRIKE WITH TWO INDEPENDENT LATCHES

BACKGROUND OF THE INVENTION

The present invention has to do with electric strikes. More specifically, the invention relates to an electric strike having two independent keepers which is intended to work with a lockset having both a mortise lock bolt and a deadbolt.

SUMMARY OF THE INVENTION

The strike of the invention has a top latch and a bottom latch. Each latch is independently operable. A use for the strike, for example, is a dorm room where students can use their credentials to unlock the bottom latch only. The deadbolt on top when thrown from inside the room will provide privacy for the occupant. However, under an emergency situation, a designated school official can unlock both the top and bottom latches with their credentials. The strike of the invention has several other applications, including in hotel rooms, public toilets, hospital showers, security rooms, laboratory clean rooms and other applications where access in an emergency situation may be needed.

DETAILED DESCRIPTION OF THE PREFERRED EMBODIMENT

Figure 1:
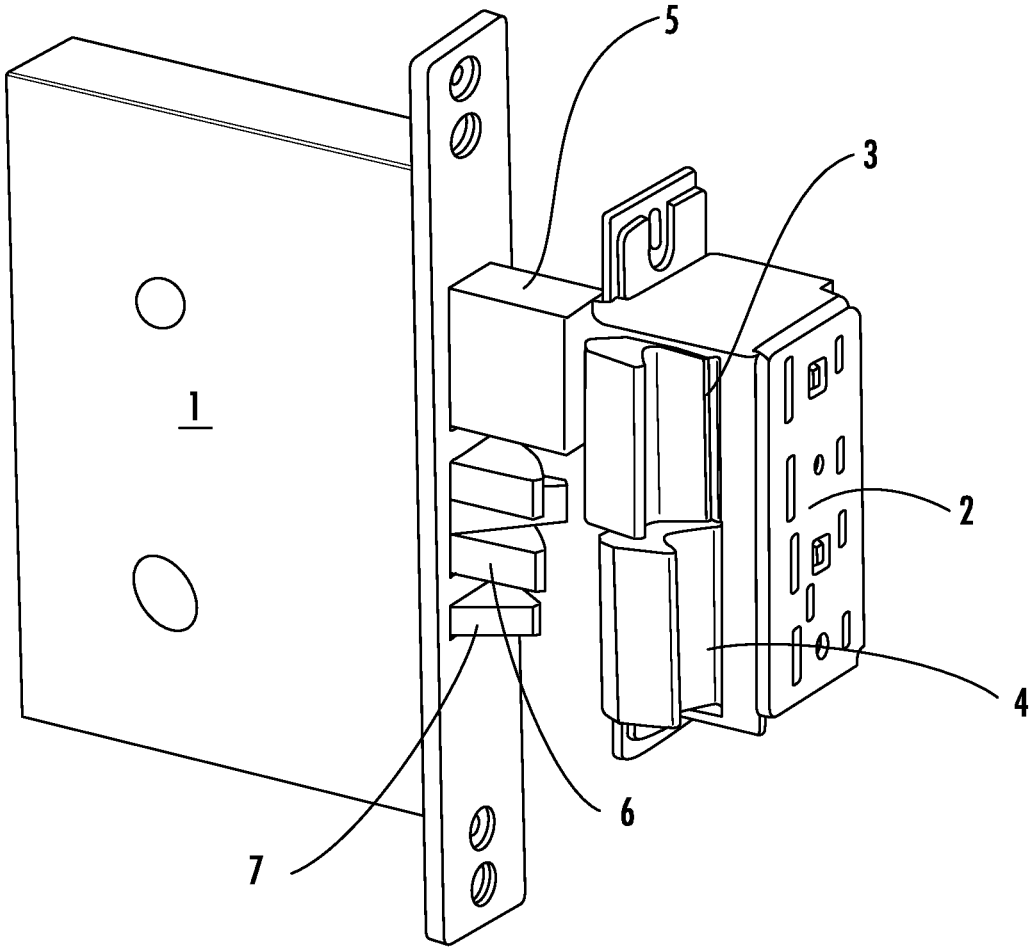
FIG. 1 is a perspective view of the electric strike of the invention and a mortise lockset.

In FIG. 1, mortise lockset 1 comprises a deadbolt 5, a conventional or anti-friction mortise lock bolt 6 and a dead locking trigger 7. Electric strike 2 of the invention comprises a top latch 3 and a bottom latch 4. Top latch 3 engages deadbolt 5 and bottom latch 4 engages mortise lock bolt 6.

Figure 6:
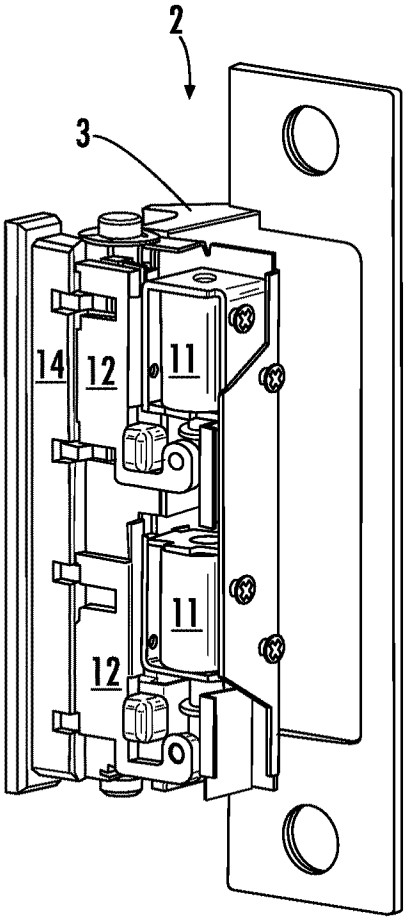
FIG. 6 is a larger scale view of the back of the electric strike without the cover.
Figure 5:
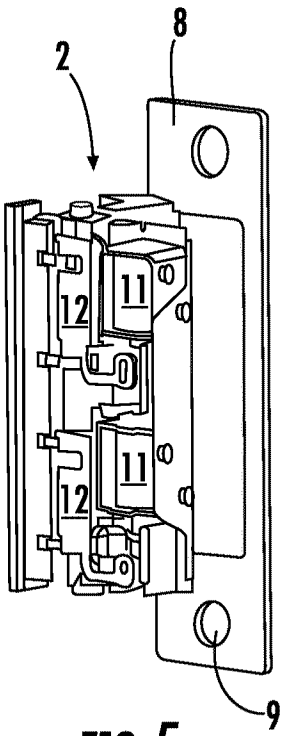
FIG. 5 is a perspective view of the back of the electric strike of the invention without the cover.
Figure 4:
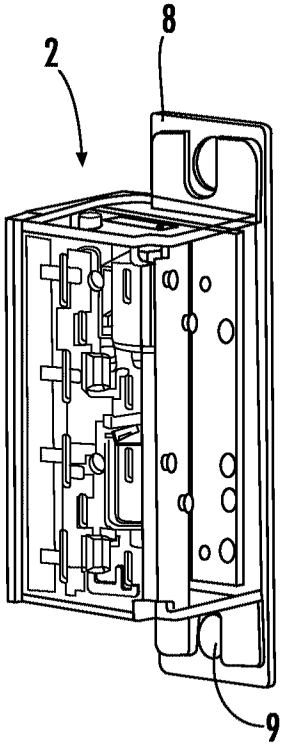
FIG. 4 is the same view as FIG. 3 illustrated with a transparent frame.
Figure 3:
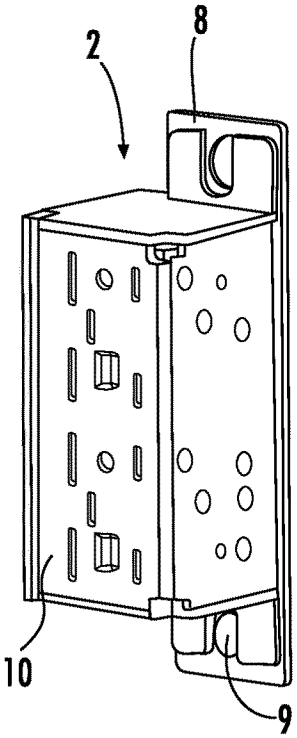
FIG. 3 is a perspective view of the back of the electric strike of the invention.
Figure 2:
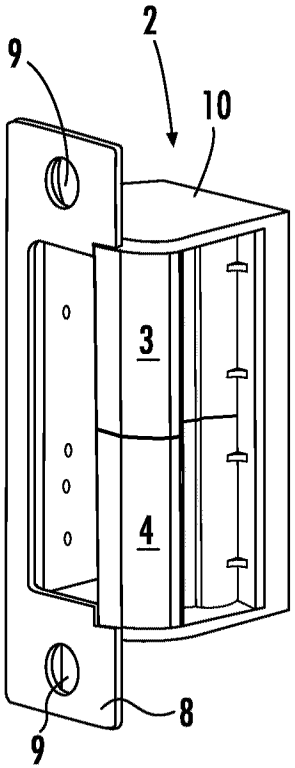
FIG. 2 is a perspective view of the front of the electric strike of the invention.

FIG. 2 is a perspective view of the front of strike 2. Face plate 8 is provided with screw holes 9 for fastening the strike to a door (not shown) using conventional screws (not shown) as will be apparent to those having ordinary skill in the art. Sheet metal frame 10 houses the components of strike 2 including top latch 3 and bottom latch 4. A perspective view of the back of strike 2 is illustrated in FIG. 3. FIG. 4 is a view from the same direction as FIG. 3 except that frame 10 is transparent. FIG. 5 is a view from the same direction as FIGS. 3 and 4 except that the frame 10 has been removed. FIG. 6 is a larger scale view of FIG. 5 which has been rotated slightly to the right in order to make the components of strike 2 more visible.

In FIGS. 5 and 6, the top locking mechanism is shown wherein the solenoid is energized, the locking slider is moved up, the keeper detente is clear and the keeper is free to pivot open. The bottom locking mechanism is shown with the solenoid de-energized and the locking slider is pulled down by gravity to lock the keeper. A solenoid 11 and a fail secure slider 12 are provided for each of the top latch 3 and bottom latch 4. Each slider is independently operable. Element 14 is a pick guard for each locking mechanism which is illustrated in more detail in FIGS. 7 and 10.

Figure 7:
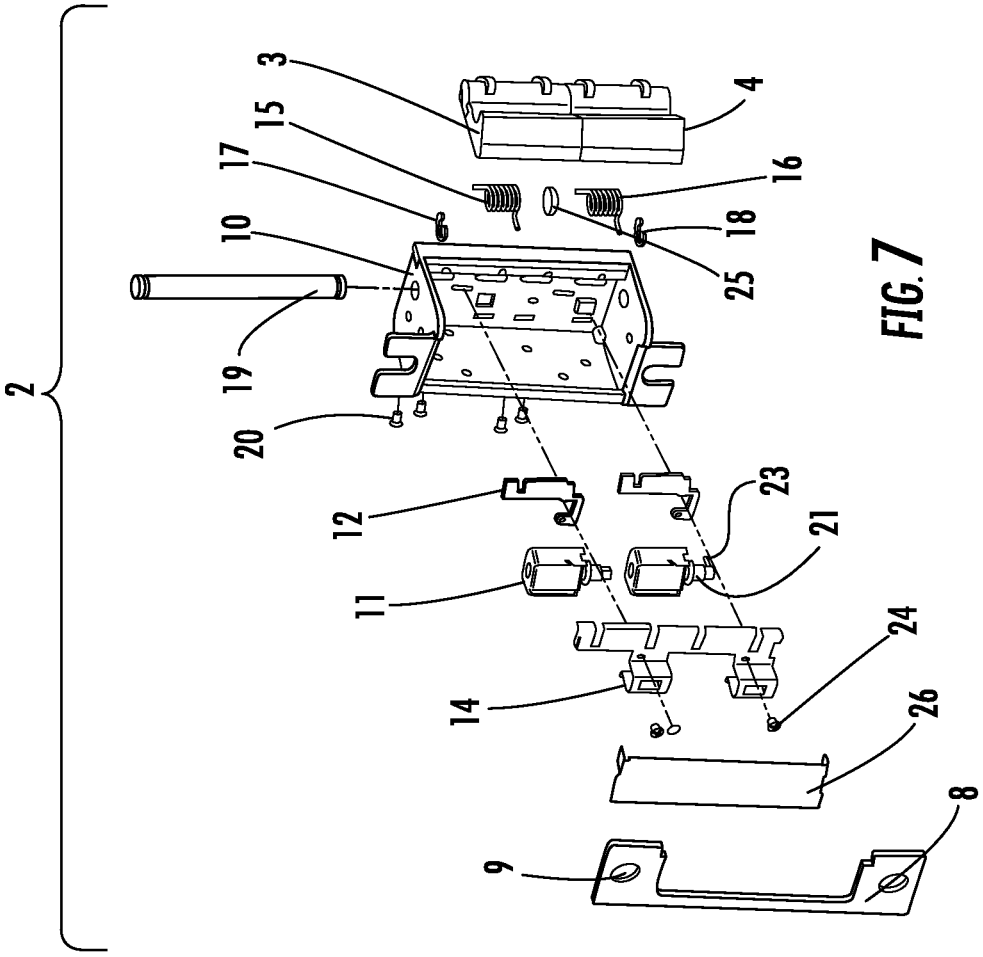
FIG. 7 is an exploded view of a right handed embodiment of the electric strike of the invention.
Figure 12:
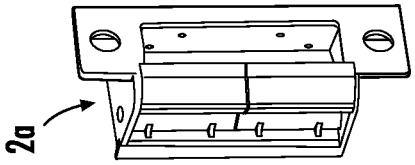
FIG. 12 is a perspective view of the front of an assembled electric strike of FIG. 10.
Figure 11:
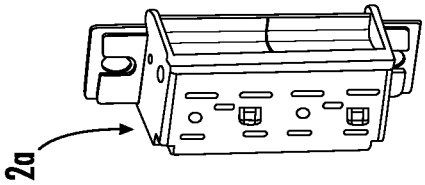
FIG. 11 is a perspective view of the back of an assembled electric strike of FIG. 10.

An exploded view of strike 2 is illustrated in FIG. 7. This is a right handed strike and FIGS. 1-6 also illustrate the right handed strike. A left handed strike 2*a* is illustrated in FIGS. 10-12. All of the elements of strike 2*a* are the same as strike 2 except that, to the extent required, they are left handed. In FIGS. 10-12 the letter "a" has been added to the reference numerals to indicate that they are for the left handed strike 2*a*. The function of each element is the same as that of strike 2 and the below discussion of FIGS. 7-9 would be the same as a discussion of FIGS. 10-12 except for the "a" designation added to the reference numerals.

Referring in more detail to FIG. 7, expanded strike 2 from right to left, comprises top and bottom latches 3 and 4, top and bottom latch return springs 15 and 16 and top and bottom pivot pin locking clips 17 and 18. Sheet metal frame 10 houses the components of strike 2. Latch pivot pin 19 accommodates both latches and both springs. Each latch pivots independently on pivot pin 19. Pivot pin locking E-clip 17 pivotably secures the top portion of pivot pin 19 and pivot pin locking E-clip 18 pivotably secures the bottom portion of pivot pin 19. Latch pivot sleeve 25 is provided between springs 15 and 16. One of several screws for securing components to the frame is designated by the reference numeral 20. Top and bottom fail secure sliders 12 each are provided with a pin opening 22 to accommodate a pin 23 of a solenoid plunger 21. Pick guard 14 is fastened to the strike housing with screws 24. A solenoid cover 26 is provided and face plate 8 has two screw holes 9 for fastening the strike 2 to a door.

Figure 9:
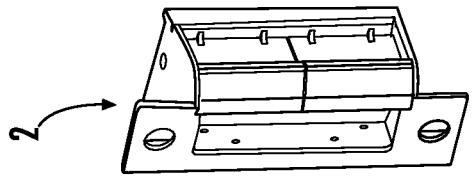
FIG. 9 is a perspective view of the front of an assembled electric strike of FIG. 7.
Figure 8:
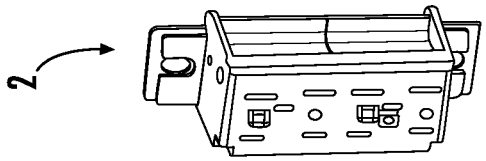
FIG. 8 is a perspective view of the back of an assembled electric strike of FIG. 7.
Figure 10:
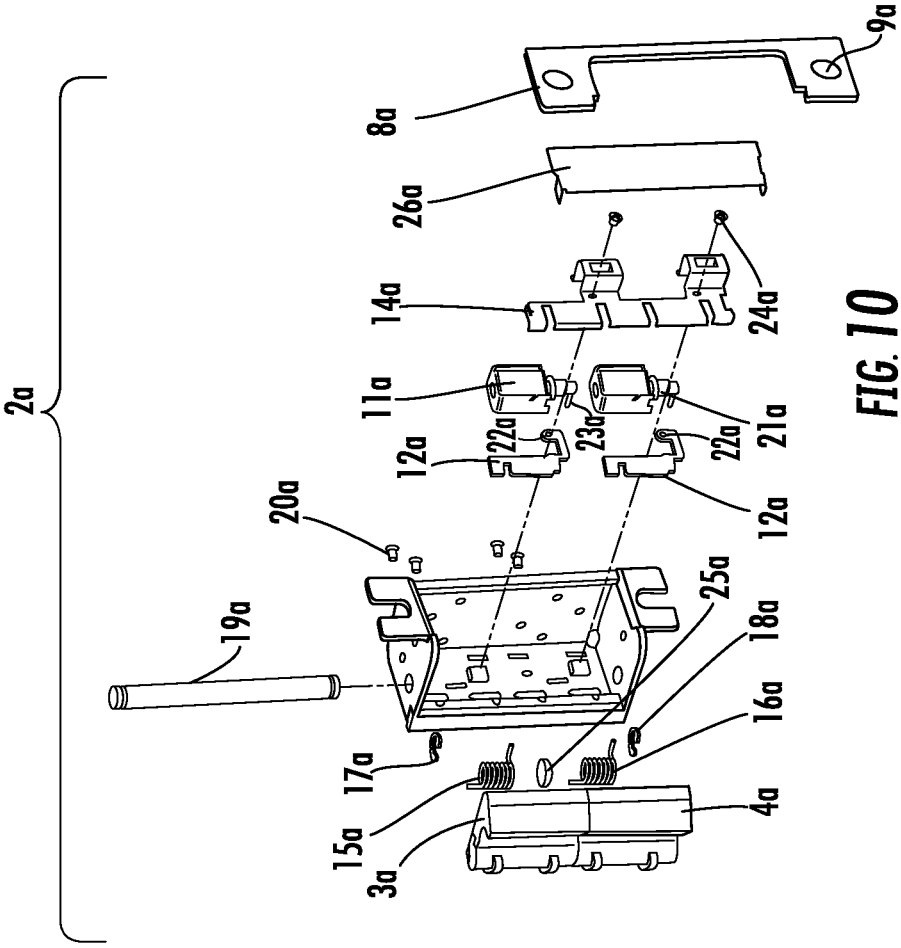
FIG. 10 is an exploded view of a left handed embodiment of the electric strike of the invention.

FIGS. 8 and 9 are perspective views of the back and front, respectively, of assembled right hand strike 2. FIGS. 11 and 12 are perspective views of the back and front, respectively of assembled left hand strike 2*a*.

It should be noted that the strike keepers can be configured as fail-safe or fail-secure independently for special applications or as may be required by the user. For example, both keepers can be unlocked when the power is cut or only the deadbolt latch will unlock when the power is cut. But if the deadbolt is thrown, the door will still be locked.

We claim:

1. An electric strike comprising:

a top latch adapted to engage a deadbolt and a top solenoid arranged to unlock or lock said top latch, a bottom latch adapted to engage a mortise lock bolt and a bottom solenoid arranged to unlock or lock said bottom latch, a fail secure slider for each of the top latch and the bottom latch, each fail secure slider being independently operable, and wherein each latch is independently operable.

2. The electric strike of claim 1 wherein the electric strike is engageable with a mortise lock bolt which is a conventional bolt or is an anti-friction bolt.

3. The electric strike of claim 1 comprising a right handed strike or a left handed strike.

4. The electric strike of claim 1, further comprising a pick guard.

5. The electric strike of claim 1 further comprising a pivot pin which accommodates both the top latch and the bottom latch, each latch being independently pivotable thereon.

6. The electric strike of claim 5 further comprising top latch and the bottom latch return springs disposed on the pivot pin and engaged with the top and bottom latch respectively, the latch return springs being separated by a sleeve disposed on the pivot pin between the springs.

7. The electric strike of claim 1 each of the top latch and bottom latch is configured as fail safe or fail secure.

8. The electric strike of claim 1 wherein one of the top latch and one of the bottom latch is configured as fail safe and the other said latch is configured as fail secure.

* * * * *